US009427887B2

(12) United States Patent
Krentz et al.

(10) Patent No.: US 9,427,887 B2
(45) Date of Patent: Aug. 30, 2016

(54) CONCRETE PRODUCT MOLDING MACHINE VIBRATION DRIVE APPARATUS

(71) Applicant: Besser Company, Alpena, MI (US)

(72) Inventors: Douglas Krentz, Alpena, MI (US); Daniel Maurice Failla, Lincoln, MI (US)

(73) Assignee: Besser Company, Alpena, MI (US)

( * ) Notice: Subject to any disclaimer, the term of this patent is extended or adjusted under 35 U.S.C. 154(b) by 4 days.

(21) Appl. No.: 14/173,446

(22) Filed: Feb. 5, 2014

(65) Prior Publication Data

US 2014/0220172 A1 Aug. 7, 2014

Related U.S. Application Data

(60) Provisional application No. 61/850,040, filed on Feb. 5, 2013.

(51) Int. Cl.

| | |
|---|---|
| ***B28B 1/08*** | (2006.01) |
| ***B28B 1/087*** | (2006.01) |
| ***B06B 1/16*** | (2006.01) |

(52) U.S. Cl.

CPC ..... *B28B 1/0873* (2013.01); *B06B 1/16* (2013.01)

(58) Field of Classification Search

USPC ..... 425/253–255, 421, 424–425, 432, 456, 425/410

See application file for complete search history.

(56) References Cited

U.S. PATENT DOCUMENTS

| | | | | |
|---|---|---|---|---|
| 763,261 A | | 6/1904 | Chreitzberg | |
| 2,251,447 A | | 2/1938 | Gelbman et al. | |
| 3,302,262 A | * | 2/1967 | Chanlund | 425/421 |
| 3,824,060 A | * | 7/1974 | Helmrich | B30B 11/022 425/425 |
| 4,978,488 A | | 12/1990 | Wallace | |
| 5,002,711 A | * | 3/1991 | Iwama et al. | 425/421 |
| 5,355,732 A | | 10/1994 | Anderl | |
| 7,635,261 B2 | * | 12/2009 | High et al. | 425/432 |

OTHER PUBLICATIONS

Rekers Fully Variable Vibration; Rekers Maschinen-u.Antagenbau website; www.rekers.de; 1 page, Mar. 11, 2013.

Product Information Documents for OMAG, Besser Company; 17 pages.

Product Information Documents for Servopac; Besser Company; 97 pages, Mar. 30, 2010.

Product Information Documents for V8; Besser Company; 30 pages.

* cited by examiner

*Primary Examiner* — Joseph S Del Sole
*Assistant Examiner* — Thukhanh T Nguyen
(74) *Attorney, Agent, or Firm* — Reising Ethington P.C.

(57) ABSTRACT

A vibration drive assembly comprising two rotary servo motors and an electronic motor controller electrically coupled to the servo motors and configured to regulate the motors and operate them in synchronism with one another at a predetermined rotational speed. Two articulated drive trains are connectable between the servo motors and mold assembly vibrator shafts of a concrete product molding machine and are configured to mechanically transmit rotational motion from the servo motors to the vibrator shafts when the mold assembly is in an elevated vibration position with the vibrator shaft axes coaxially aligned with rotational servo motor axes. The drive trains remain connected between the servo motors and vibrator shafts when the mold assembly is in a rest position below the vibration position, with the vibrator shaft axes axially mis-aligned with respect to the servo motor axes.

20 Claims, 7 Drawing Sheets

CONCRETE PRODUCT MOLDING MACHINE VIBRATION DRIVE APPARATUS

CROSS-REFERENCES TO RELATED APPLICATIONS

This application claims the benefit of and is based on provisional patent application Ser. No. 61/850,040 filed Feb. 5, 2013.

STATEMENT REGARDING FEDERALLY SPONSORED RESEARCH OR DEVELOPMENT

Not Applicable

BACKGROUND

1. Field

This application relates generally to mold vibrators for concrete product molding machines.

2. Description of Related Art Including Information Disclosed Under 37 CFR 1.97 and 1.98

Molds for concrete product molding machines are vibrated to provide better filling of the mold. Mold vibration also assists the formation of denser concrete products by allowing the concrete to settle to a more structurally sound state. Some concrete product molding machines include a frame, and a mold assembly carried by the frame. A pallet and pallet receiver of the concrete product molding machine are raised to pick-up the mold assembly from a rest position and raise it to an elevated vibration position approximately ⅝ inch above the rest position. Two unbalanced vibrator shafts are carried by the mold assembly and are supported for rotation about respective parallel vibrator shaft axes, each vibrator shaft axis being displaced from a center of mass of that vibrator shaft so that each vibrator shaft produces off-axis force when rotated about its vibrator shaft axis. The vibrator shafts are driven in rotation by respective vibration drives comprising electric drive motors, belts, and pulleys. A concrete product molding machine of this type is disclosed, at least in part, in U.S. Pat. No. 4,978,488 issued Dec. 18, 1990 to Wallace, which is incorporated herein in its entirety, by reference.

SUMMARY

A vibration drive assembly is provided for a concrete product molding machine that comprises a frame, a mold assembly, a pallet and pallet receiver actuable to move the mold assembly between a rest position and an elevated vibration position, two unbalanced vibrator shafts carried by the mold assembly and supported for rotation about respective parallel vibrator shaft axes, each vibrator shaft axis having an eccentric center of mass such that each vibrator shaft produces off-axis force when rotated about its vibrator shaft axis. The vibration drive assembly comprises two rotary servo motors and an electronic motor controller electrically coupled to the servo motors and configured to regulate the motors and operate them in synchronism with one another at a predetermined rotational speed. Two articulated drive trains are connectable between the servo motors and the vibrator shafts and configured to mechanically transmit rotational motion from the servo motors to the vibrator shafts when the mold assembly is in its vibration position with the vibrator shaft axes coaxially aligned with rotational servo motor axes, and to remain connected between the servo motors and vibrator shafts when the mold assembly is in its rest position with the vibrator shaft axes axially mis-aligned with respect to the servo motor axes.

Also, a vibration drive assembly is provided for a concrete product molding machine that comprises a frame, a mold assembly, a mold assembly supported on the frame for motion between a rest position and an elevated vibration position, two unbalanced vibrator shafts carried by the mold assembly and supported for rotation about respective parallel vibrator shaft axes, each vibrator shaft axis having an eccentric center of mass such that each vibrator shaft produces off-axis force when rotated about its vibrator shaft axis. The vibration drive assembly comprises two rotary servo motors and an electronic motor controller electrically coupled to the servo motors and configured to regulate the motors and operate them in synchronism with one another at a predetermined rotational speed. Two articulated drive trains are connectable between the servo motors and the vibrator shafts and configured to mechanically transmit rotational motion from the servo motors to the vibrator shafts. The servo motors and attached drive trains are pivotably supportable on a concrete product molding machine frame for motion between respective stowed and deployed positions where, in their stowed positions, the servo motors and attached drive trains are disposed out of a removal and replacement path of a mold assembly of the concrete product molding machine, and where, in their deployed positions, the servo motors and attached drive trains are disposed within the removal and replacement path with the drive trains positioned adjacent vibrator shafts of the concrete product molding machine.

Also, a method is provided for retrofitting a vibration drive assembly on a concrete product molding machine that comprises a frame, a mold assembly, a pallet and pallet receiver actuable to move the mold assembly between a rest position and an elevated vibration position, two unbalanced vibrator shafts carried by the mold assembly and supported for rotation about respective parallel vibrator shaft axes, each vibrator shaft axis having an eccentric center of mass such that each vibrator shaft produces off-axis force when rotated about its vibrator shaft axis. The method includes supporting two rotary servo motors of the vibration drive assembly in respective positions with respective servo motor axes co-axially aligned with the vibrator shaft axes when the mold assembly of the molding machine is in its elevated vibration position, and connecting two articulated drive trains of the vibration drive assembly between the servo motors of the vibration drive assembly and the vibrator shafts of the molding machine, in respective positions to mechanically transmit rotational motion from the servo motors to the vibrator shafts when the mold assembly is in its vibration position with the vibrator shaft axes coaxially aligned with rotational servo motor axes, and to remain connected between the servo motors and vibrator shafts when the mold assembly is in its rest position with the vibrator shaft axes axially mis-aligned with respect to the servo motor axes.

DRAWING DESCRIPTIONS

These and other features and advantages will become apparent to those skilled in the art in connection with the following detailed description and drawings of one or more embodiments of the invention, in which.

Figure 3:
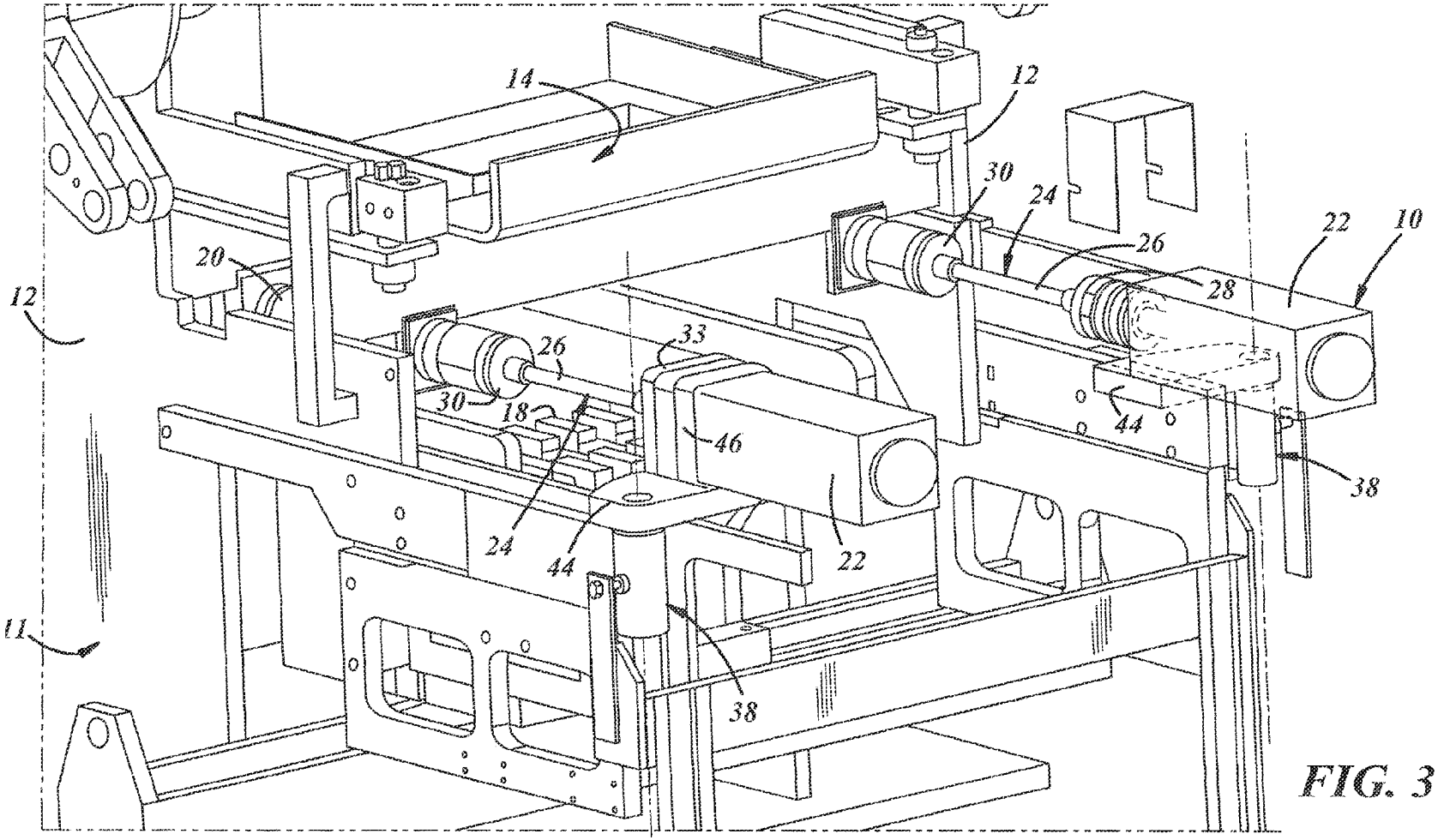
FIG. 3 is a partial orthogonal view of the prior art concrete product molding machine of FIG. 1 with the vibrator shafts connected to vibration drives constructed according to the present disclosure.
Figure 8:
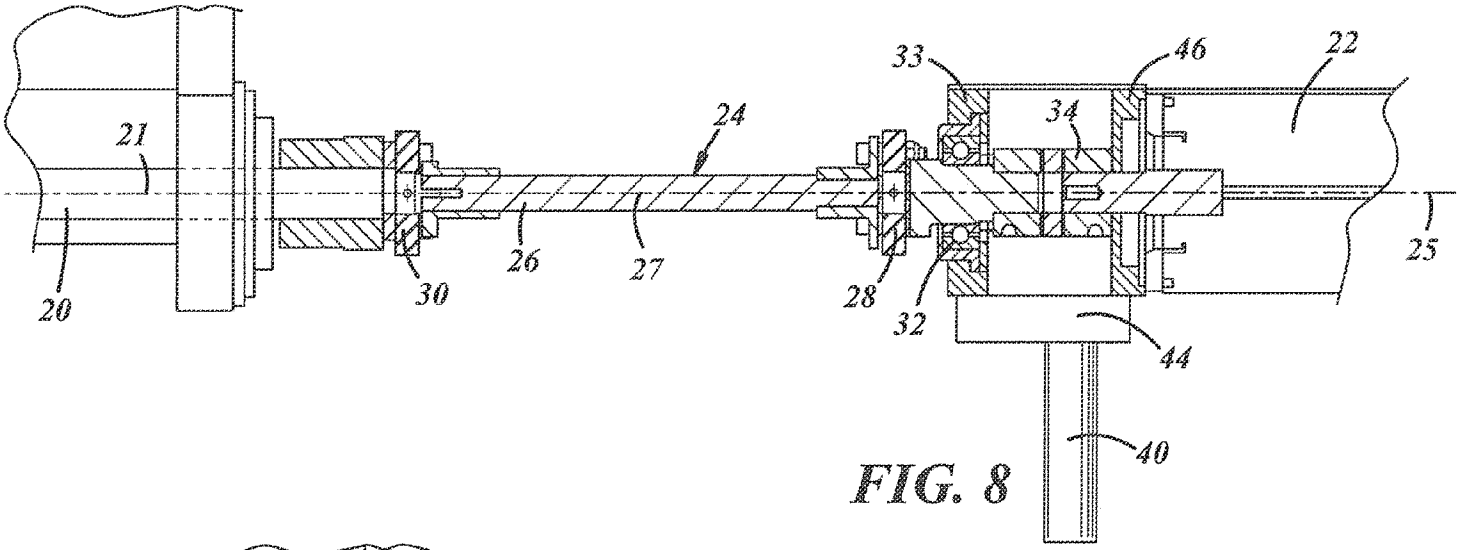
Figure 9:
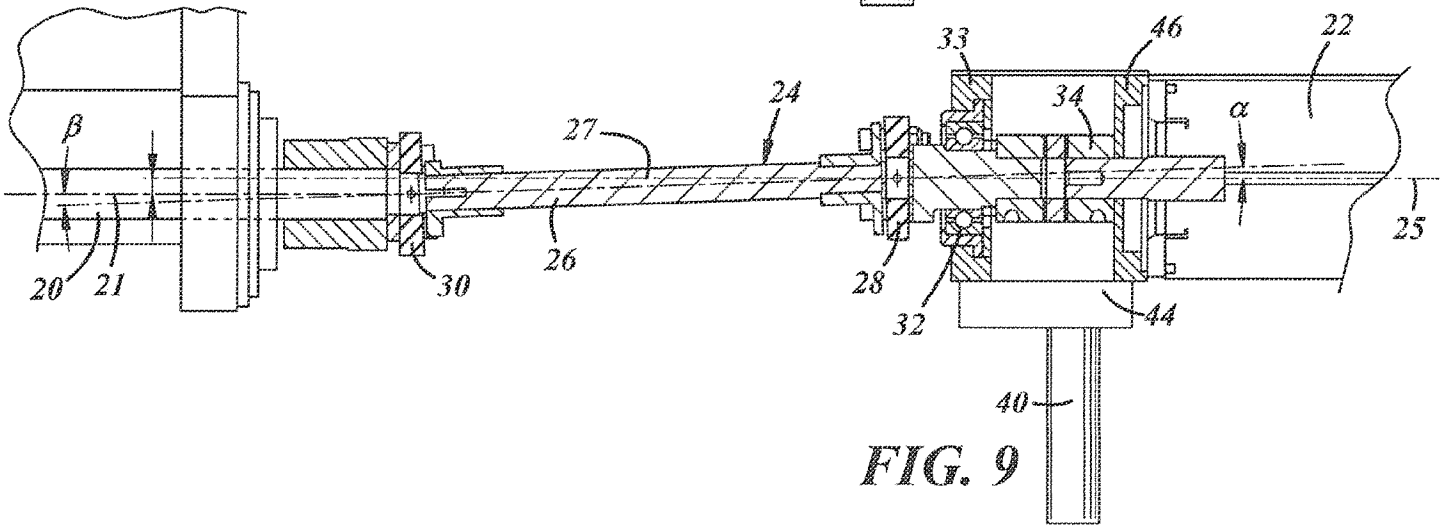

FIG. 8 is a magnified partially cut-away side view of one of the vibrator shafts of the removable mold assembly of the concrete product molding machine of FIG. 3, connected to a drive train of one of the vibration drives of FIG. 3, with the removable mold assembly in its vibration position and vibrator shaft, drive train, and motor axes coaxially aligned; and FIG. 9 is a magnified partially cut-away side view of the vibrator shaft of FIG. 8 connected to the drive train of FIG. 8, with the removable mold assembly of the concrete product molding machine in its rest position and with vibrator shaft, drive train, and motor axes axially mis-aligned.

DETAILED DESCRIPTION

Figure 4:
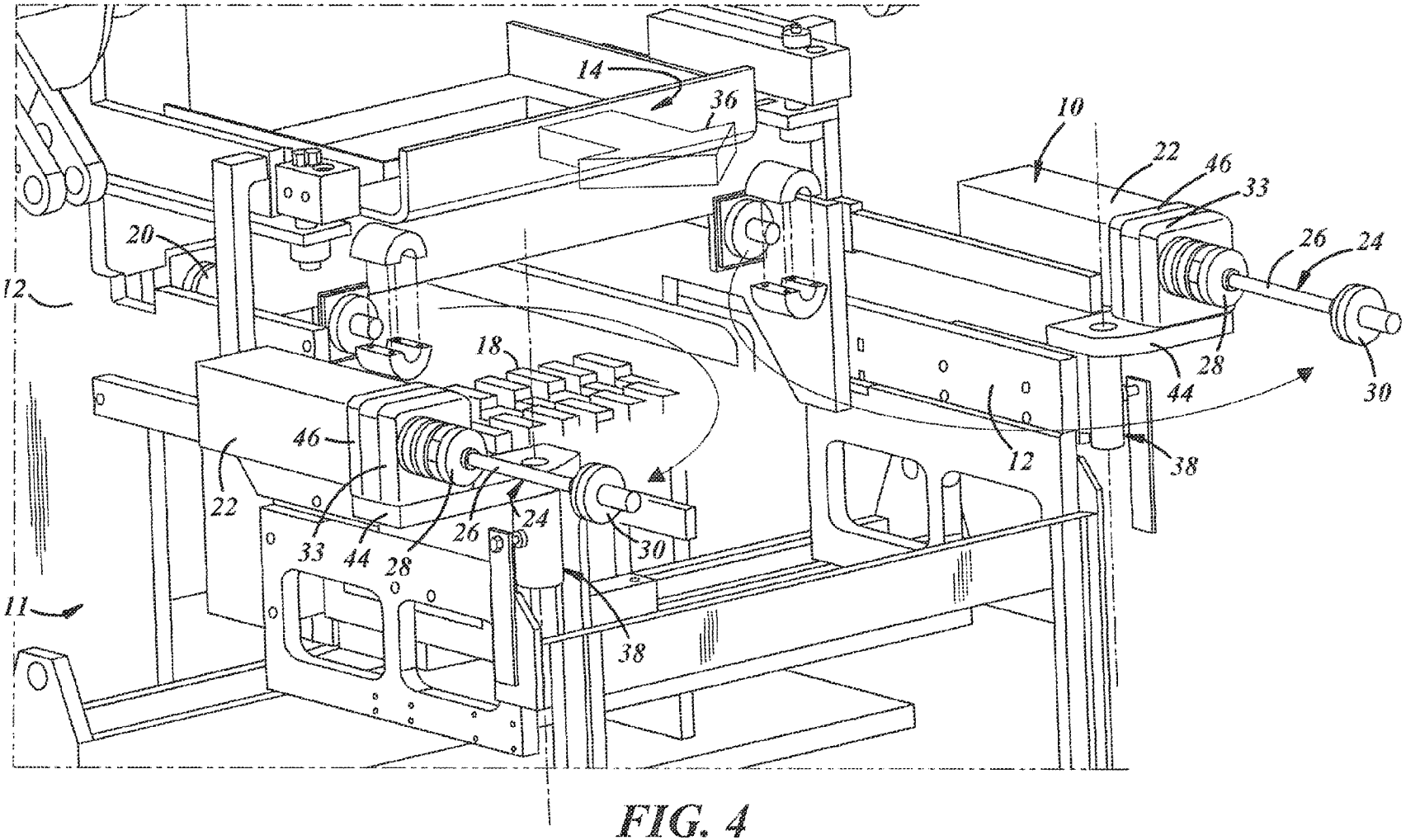
FIG. 4 is a partial orthogonal view of the prior art concrete product molding machine of FIG. 1 with motors and drive trains of the vibration drives disconnected from vibrator shafts and rotated out of a removal path of the removable mold assembly of the prior art concrete products molding machine.
Figure 5:
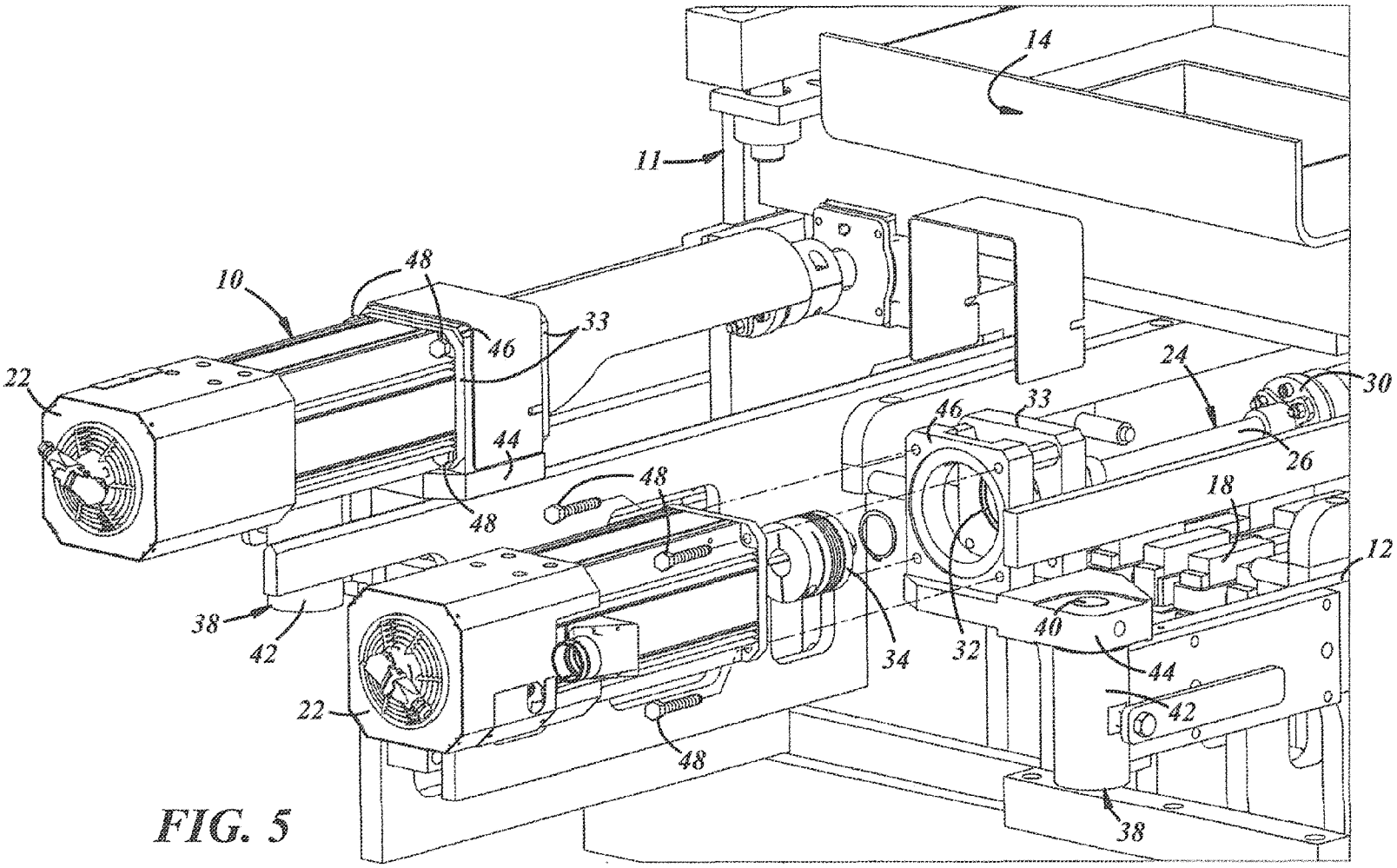
FIG. 5 is an orthogonal view of the concrete product molding machine and vibration drives of FIG. 3 including a partial exploded view of a drive train of one of the two vibration drives.

A vibration drive assembly for retrofit on a concrete product molding machine is generally shown at 10 in FIGS. 3-7. A concrete product molding machine, of the type for which the vibration drive assembly 10 is designed for retrofit, is shown at 11 in FIGS. 1 and 3-7. As best shown in FIGS. 3-5, a molding machine of this type comprises a frame 12, a removable mold assembly 14, a pallet (not shown), and a pallet receiver 18. The pallet receiver 18 is actuable to move the mold assembly 14 between a rest position and an elevated vibration position that may be spaced approximately ⅝ inch above the rest position. It is in the elevated vibration position where the mold assembly 14 is subjected to vibration.

Figure 1:
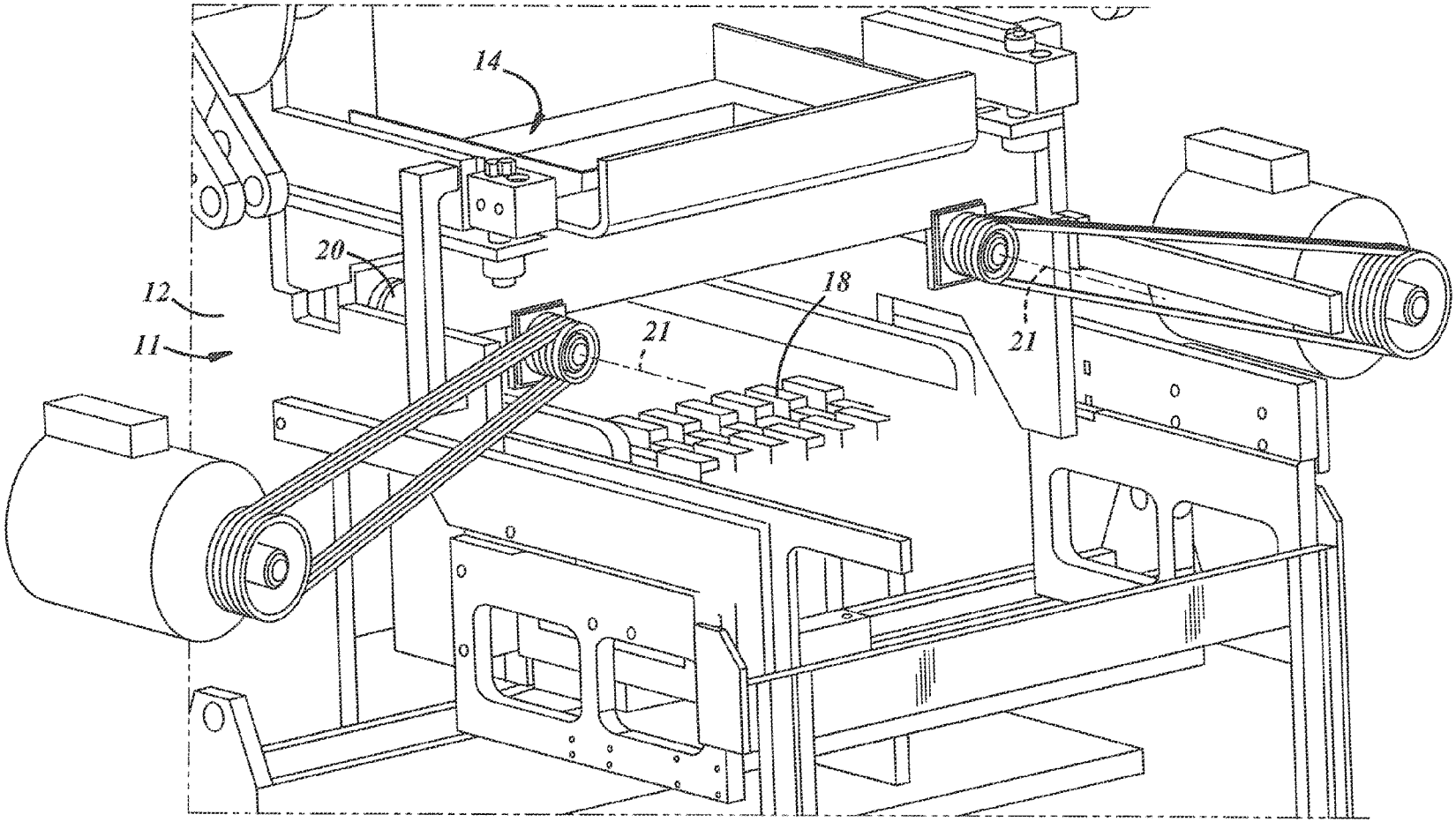
(Prior Art) FIG. 1
FIG. 1 is a partial, fragmentary, orthogonal view of a prior art concrete product molding machine having a removable mold assembly comprising a concrete product mold and two vibrator shafts driven by prior art vibration drives comprising electric motors, pulleys, and drive belts.
Figure 2:
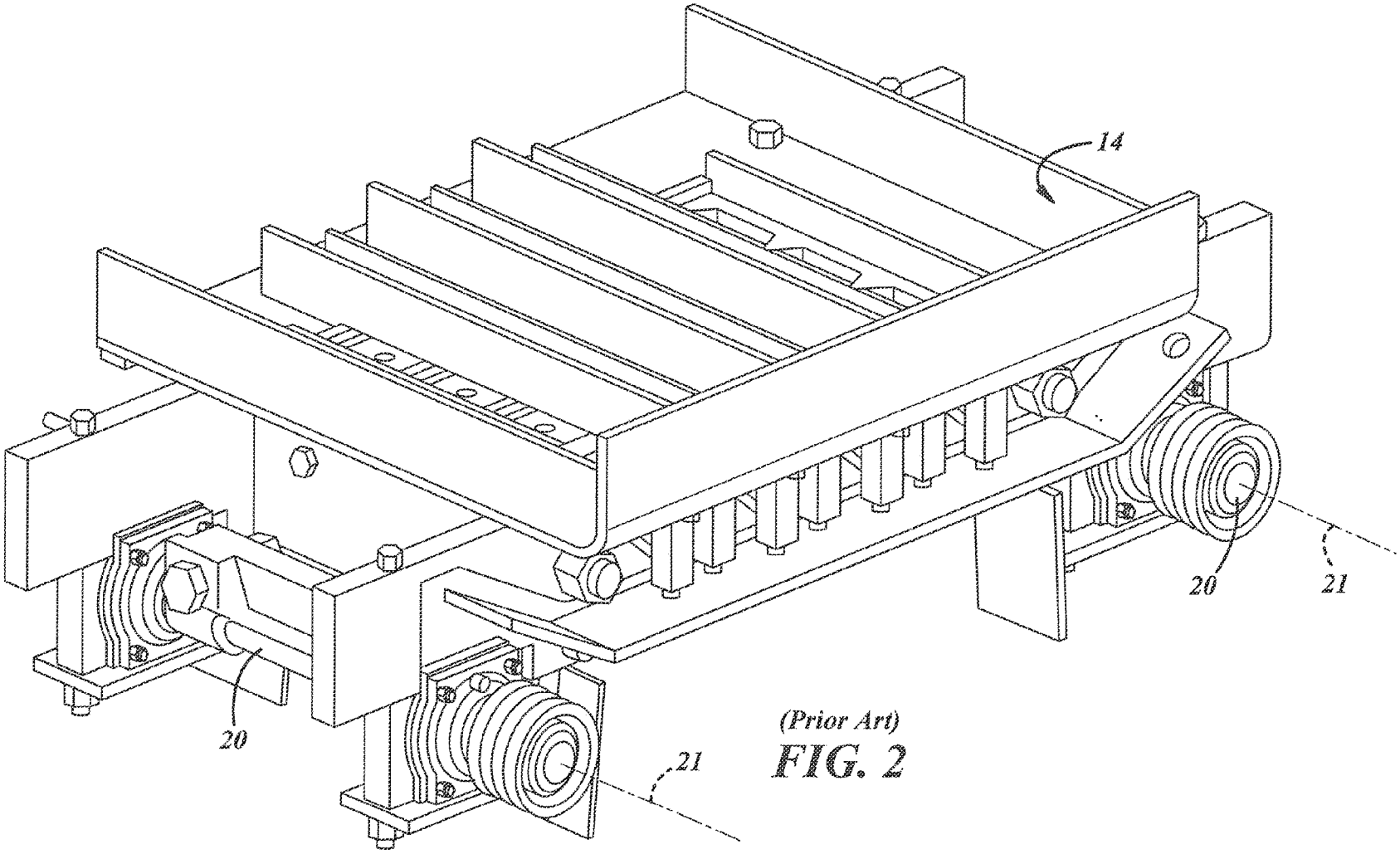
(Prior Art) FIG. 2
FIG. 2 is an orthogonal view of the removable mold assembly of the prior art molding machine of FIG. 1.

As best shown in FIGS. 2, 8, and 9, two unbalanced vibrator shafts 20 are carried by the mold assembly 14 and are supported for rotation about respective parallel vibrator shaft rotational axes 21. Each vibrator shaft 20 has an eccentric center of mass (i.e., a center of mass displaced from a rotational axis 21 of that vibrator shaft 20) such that each vibrator shaft 20 produces off-axis force when rotated about its vibrator shaft axis 21.

As shown in FIGS. 3-7, the drive assembly 10 may include two closed-loop rotary servo motors 22 such as, for example, synchronous servo motors available from Rexroth under the product designation IndraDyn S MSK. As best shown in FIGS. 3-5, two articulated drive trains 24 may be connected between the servo motors 22 and the vibrator shafts 20 and configured to mechanically transmit rotational motion from the servo motors 22 to the vibrator shafts 20, i.e., to rotate the vibrator shafts 20 about their respective vibrator shaft axes 21 when the mold assembly 14 is in its raised vibration position, as best shown in FIG. 8, with the vibrator shaft axes 21 coaxially aligned with rotational servo motor axes 25. The drive trains 24 may be configured to remain connected between the servo motors 22 and vibrator shafts 20 when the mold assembly 14 is in its rest position, as best shown in FIG. 9, with the vibrator shaft axes 21 displaced vertically and axially mis-aligned (i.e., not coaxially aligned) with respect to the servo motor axes 25.

As shown in FIGS. 3-5, each drive train 24 may include a drive shaft 26 and a first flexible coupling 28 connected between the servo motor 24 and the first end of the drive shaft 26. The first flexible coupling 28 may be configured to transmit rotation from the servo motor 24 to the drive shaft 26 and to permit relative angular motion between the drive shaft 26 and the servo motor 24 when the mold assembly 14 is moved between its rest position and elevated vibration position. A second flexible coupling 30 may be carried by each drive shaft 26. The second flexible coupling 30 may be connected between a second end of each drive shaft 26 and one of the vibrator shafts 20 and configured to transmit rotation from each drive shaft 26 to a respective corresponding vibrator shaft 20 and to permit relative angular motion between the drive shafts 26 and the vibrator shafts 20. The flexible couplings 28, 30 may comprise any suitable coupling, for example, joint disk couplings available from SGF.

As best shown in FIG. 9 each drive train 24 may include a drive train support bearing 32 carried by a drive train support bracket 33 that is carried by the frame 12. The support bearing 32 may support the drive train 24 for rotation about a drive shaft axis 27, thereby extending servo motor life by reducing loads applied to a front end bearing of the servo motor 24. The drive train support bearing 32 may be of any suitable type to include, for example, a double row ball bearing available from SKF.

As shown in FIG. 9, each drive train 24 may include an axial float coupling 34 connected in the drive train 24 between the servo motor 24 and the drive shaft 26. The axial float coupling 34 may extend servo motor life by reducing axial loads applied to the servo motor 24. The axial float coupling 34 may be of any suitable type to include, for example, an EKH/300 coupling available from R+W® Coupling Technology.

As shown in FIG. 9, the drive shaft 26 of each drive train 24 may have a length sufficient to limit a first acute angle $\alpha$ measured between the drive shaft axis 27 and servo motor axis 25 and a second acute angle $\beta$ measured between the drive shaft axis 27 and the vibrator shaft axis 21 (when the drive train 24 is connected to a vibrator shaft 20 of the concrete product molding machine 11 and the mold assembly 14 of the concrete product molding machine 11 is in its rest position), to less than respective maximum angles allowable by the first and second flexible couplings 28, 30 for a given distance between the rest position and elevated vibration position of the mold assembly 14 of a concrete product molding machine 11 to which the drive trains 24 are to be connected, where the distance between rest and elevated positions is measured in a direction generally normal to the orientation of the drive shaft 26 when the drive train 24 is connected to a vibrator shaft 20 of the concrete product molding machine 11.

Figure 6:
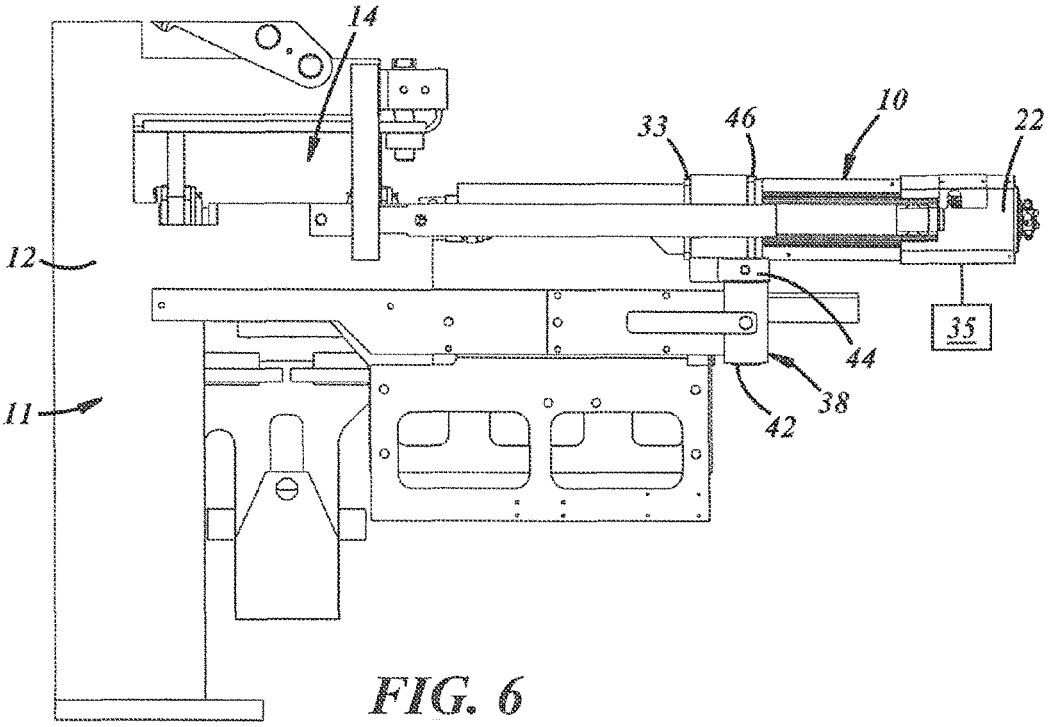
FIG. 6 is a side view of the concrete product molding machine and one of the vibration drives of FIG. 3.
Figure 7:
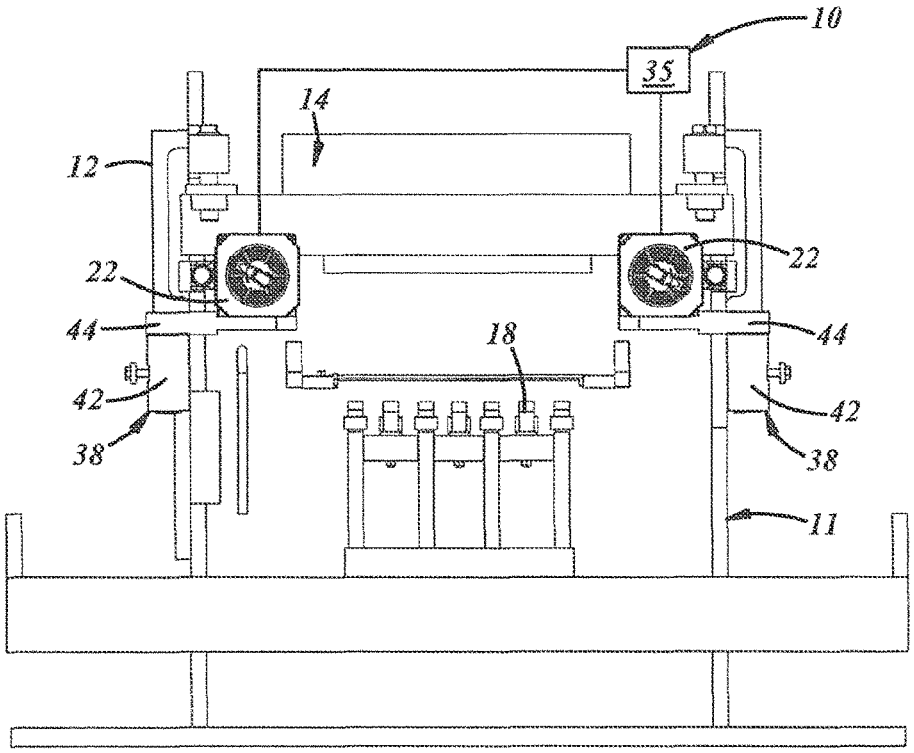
FIG. 7 is an end view of the concrete product molding machine and vibration drives of FIG. 3.

As shown in FIGS. 6 and 7, an electronic motor controller 35 may be electrically coupled to the servo motors 22. The motor controller 35 may be configured to regulate the motors 22 and operate them in synchronism with one another at a predetermined rotational speed as disclosed, for example, in U.S. Pat. No. 5,355,732 issued Oct. 18, 1994 to Anderl et al. and incorporated herein in its entirety, by reference. The motor controller 35 may be configured to change the vibrating frequencies of the vibrator shafts 20 by changing their rotational speed and/or the motor controller 35 may be configured to change vibration amplitude by changing the vibrating frequencies of the vibrator shafts 20.

As shown in FIGS. 3 and 4, the servo motors 22 and attached drive trains 24 may be pivotably supported on the frame 12 for motion between respective stowed and deployed positions. In their stowed positions, shown in FIG. 4, the servo motors 22 and attached drive trains 24 may be disposed out of a removal and replacement path 36 of a mold assembly 14 of the concrete product molding machine 11 to facilitate the clearing of the removal and replacement path 36 for the mold assembly 14. In their deployed positions, shown in FIG. 3, the servo motors 22 and attached drive trains 24 are disposed within the removal and replacement path 36 with the drive trains 24 positioned adjacent the vibrator shafts 20 of the concrete product molding machine 11 for attachment thereto.

To enable the pivotable mounting of the motors 22 and drive trains 24, the drive assembly 10 may include two pivot mount assemblies 38 best shown in FIG. 5. Each such assembly 38 may comprise a vertical pivot shaft 40 supported for rotational motion within a pivot mount sleeve 42 fixed to the concrete product molding machine frame 12, a hinge plate 44 fixed to the pivot shaft 40, and a motor mount 46 fixed to the hinge plate 44. Each motor mount 46 may removably carry one of the servo motors 22. The servo motor 24 may be removably attached to the motor mount 46 by four fasteners 48.

The vibration drive assembly 10 may be retrofit on a concrete product molding machine 11 by removing belts and pulleys from the vibrator shafts 20 of the molding machine 11 and pivotably supporting the two rotary servo motors 22 of the vibration drive assembly 10 in respective positions on the frame 12 of the molding machine 11, where respective servo motor axes are co-axially alignable with the vibrator shaft axes of the mold assembly of the molding machine when the mold assembly is in its elevated vibration position. The two articulated drive trains 24 of the vibration drive assembly 10 are assembled and connected between the servo motors 22 of the vibration drive assembly 10 and the vibrator shafts 20 of the molding machine 11. The servo motors 22 are connected to the motor controller 35 and the motor controller 35 is programmed to operate the servo motors 22 in synchronism with one another and rotate the vibrator shafts 20 of the molding machine at a predetermined rotational speed when the mold assembly 14 of the molding machine 11 is in its vibration position, and may be further programmed to prevent the servo motors 22 from rotating the vibrator shafts 20 of the molding machine 11 when the mold assembly 14 of the molding machine 11 is in its rest position.

A vibration drive assembly 10, as described above, provides force amplitude control of vibrator shafts 20 of a concrete product molding machine 11 and replaces a belt drive with a direct drive via servo motors 22 and drive trains 24 that can be easily disconnected and rotated to clear a path for mold assembly 14 removal and replacement. The articulation of the drive trains 24 allows them to remain connected when the mold assembly 14 is lowered to its rest position between vibration operations.

This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A vibration drive assembly for a concrete block molding machine that comprises a frame, a mold assembly supported on a frame for motion between a rest position and an elevated vibration position, two unbalanced vibrator shafts carried by the mold assembly and supported for rotation about respective vibrator shaft axes, each vibrator shaft having an eccentric center of mass such that each vibrator shaft produces off-axis force when rotated about its vibrator shaft axis; the vibration drive assembly comprising:

two rotary servo motors;

an electronic motor controller electrically coupled to the servo motors and configured to regulate the motors; and two articulated drive trains connectable between the servo motors and the vibrator shafts and configured to mechanically transmit rotational motion from the servo motors to the vibrator shafts, the servo motors and drive trains being in axial alignment with the vibrator shafts of the block molding machine mold assembly when the mold assembly is in its elevated vibration position.

2. A vibration drive assembly as defined in claim 1 in which the electronic motor controller is configured to actuate the servo motors to mechanically transmit rotational motion from the servo motors to the vibrator shafts of the molding machine when the mold assembly is in its vibration position with the vibrator shaft axes coaxially aligned with rotational servo motor axes, and to refrain from transmitting rotation motion to the vibrator shafts when the mold assembly is in its rest position with the vibrator shaft axes axially mis-aligned with respect to the servo motor axes.

3. A vibration drive assembly as defined in claim 1 in which each drive train includes at least one flexible coupling connectable between one of the servo motors and one of the vibrator shafts of the block molding machine mold assembly.

4. A vibration drive assembly for a concrete block molding machine that comprises a frame, a mold assembly supported on a frame for motion between a rest position and an elevated vibration position, two unbalanced vibrator shafts carried by the mold assembly and supported for rotation about respective vibrator shaft axes, each vibrator shaft having an eccentric center of mass such that each vibrator shaft produces off-axis force when rotated about its vibrator shaft axis; the vibration drive assembly comprising:

two rotary servo motors;

an electronic motor controller electrically coupled to the servo motors and configured to regulate the motors;

two articulated drive trains connectable between the servo motors and the vibrator shafts and configured to mechanically transmit rotational motion from the servo motors to the vibrator shafts, the servo motors and drive trains being in axial alignment with the vibrator shafts of the block molding machine mold assembly when the mold assembly is in its elevated vibration position, each drive train including:

a drive shaft;

a first flexible coupling connected between its respective servo motor and the first end of the drive shaft and configured to transmit rotation from the servo motor to the drive shaft and to permit relative angular motion between the drive shaft and the servo motor;

a second flexible coupling connectable between a second end of the drive shaft and one of the vibrator shafts of the block molding machine mold assembly and configured to transmit rotation from the drive shaft to the vibrator shaft and to permit relative angular motion between the drive shaft and the vibrator shaft; and a motor pivot mount pivotably supporting one of the servo motors on the frame.

5. A vibration drive assembly as set forth in claim 4 in which the drive shaft of each drive train has a length sufficient to limit a first acute angle measured between the drive shaft axis and servo motor axis and a second acute angle measured between the drive shaft axis and the vibrator shaft axis, to less than respective maximum angles allowable by the first and second flexible couplings for a given distance between the rest position and elevated vibration position of the mold assembly of a concrete product molding machine to which the drive trains are to be connected, the distance being measured in a direction generally normal to the orientation of the drive shaft when the drive train is connected to a vibrator shaft of the block molding machine mold assembly.

6. A vibration drive assembly as set forth in claim 1 in which the motor controller is configured to change the vibrating frequencies of the vibrator shafts of the block molding machine mold assembly by changing their rotational speed.

7. A vibration drive assembly as set forth in claim 6 in which the motor controller is configured to change vibration amplitude by changing the vibrating frequencies of the vibrator shafts of the block molding machine mold assembly.

8. A vibration drive assembly as defined in claim 1 in which the drive train includes a drive train support bearing carried by a drive train support bracket that is supportable on the frame of the molding machine and supports the drive train for rotation about the drive shaft axis.

9. A vibration drive assembly as defined in claim 1 in which the drive train includes an axial float coupling connected in the drive train.

10. A vibration drive assembly as defined in claim 1 in which the servo motors and attached drive trains are pivotably supportable on a concrete product molding machine frame for motion between respective stowed and deployed positions where, in their stowed positions, the servo motors and attached drive trains are disposed out of a removal and replacement path of a mold assembly of the concrete product molding machine, and where, in their deployed positions, the servo motors and attached drive trains are disposed within the removal and replacement path with the drive trains positioned adjacent vibrator shafts of the block molding machine mold assembly.

11. A vibration drive assembly as defined in claim 10 and further comprising two pivot mount assemblies, each such assembly comprising:

a pivot shaft supported for rotational motion within a pivot mount sleeve fixed to the concrete product molding machine frame;

a hinge plate fixed to the pivot shaft; and a motor mount fixed to the hinge plate and removably carrying one of the servo motors.

12. A vibration drive assembly for a concrete product molding machine that comprises a frame, a mold assembly supported on the frame for motion between a rest position and an elevated vibration position, two unbalanced vibrator shafts carried by the mold assembly and supported for rotation about respective parallel vibrator shaft axes, each vibrator shaft having an eccentric center of mass such that each vibrator shaft produces off-axis force when rotated about its vibrator shaft axis;

the vibration drive assembly comprising:

two rotary servo motors;

an electronic motor controller electrically coupled to the servo motors and configured to regulate the motors; and two articulated drive trains connectable between the servo motors and the vibrator shafts and configured to mechanically transmit rotational motion from the servo motors to the vibrator shafts;

the servo motors and attached drive trains being pivotably supportable on a concrete product molding machine frame for motion between respective stowed and deployed positions where, in their stowed positions, the servo motors and attached drive trains are disposed out of a removal and replacement path of a mold assembly of the concrete product molding machine, and where, in their deployed positions, the servo motors and attached drive trains are disposed within the removal and replacement path with the drive trains positioned adjacent vibrator shafts of the block molding machine mold assembly.

13. A vibration drive assembly as defined in claim 12 and further comprising two pivot mount assemblies, each such assembly comprising:

a pivot shaft supported for rotational motion within a pivot mount sleeve fixed to the concrete product molding machine frame;

a hinge plate fixed to the pivot shaft; and a motor mount fixed to the hinge plate and removably carrying one of the servo motors.

14. A method for retrofitting a vibration drive assembly on a concrete block molding machine that comprises a frame, a mold assembly supported on the frame for motion between a rest position and an elevated vibration position, two unbalanced vibrator shafts carried by the mold assembly and supported for rotation about respective parallel vibrator shaft axes, each vibrator shaft having an eccentric center of mass such that each vibrator shaft produces off-axis force when rotated about its vibrator shaft axis; the method comprising:

supporting two rotary servo motors of the vibration drive assembly in respective positions where respective servo motor axes are co-axially aligned with the vibrator shaft axes of the mold assembly of the block molding machine when the mold assembly is in its elevated vibration position; and connecting two articulated drive trains of the vibration drive assembly between the servo motors of the vibration drive assembly and the vibrator shafts of the block molding machine mold assembly.

15. The method of claim 14 including the additional step of connecting to the servo motors a controller configured to operate the servo motors in synchronism with one another at a predetermined rotational speed.

16. The method of claim 14 including the additional step of connecting to the servo motors a controller configured to allow the servo motors to rotate the vibrator shafts of the block molding machine mold assembly when the mold assembly is in its vibration position.

17. The method of claim 14 including the additional step of connecting to the servo motors a controller configured to prevent the servo motors from rotating the vibrator shafts of the block molding machine mold assembly when the mold assembly is in its rest position.

18. A vibration drive assembly as defined in claim 1 in which the electronic motor controller is configured to regulate the motors and operate them in synchronism with one another at a predetermined rotational speed.

19. A vibration drive assembly as defined in claim 4 in which the electronic motor controller is configured to regulate the motors and operate them in synchronism with one another at a predetermined rotational speed.

20. A vibration drive assembly as defined in claim 12 in which the electronic motor controller is configured to regulate the motors and operate them in synchronism with one another at a predetermined rotational speed.

* * * * *